US007256777B2

(12) United States Patent
Jones et al.

(10) Patent No.: US 7,256,777 B2
(45) Date of Patent: Aug. 14, 2007

(54) LCD DRIVER POWER SAVING DURING EVALUATION

(75) Inventors: Kevin Jones, Swindon (GB); Julian Tyrrell, Swindon (GB)

(73) Assignee: Dialog Semiconductor GmbH, Kircheim / Teck-Nabern (DE)

( * ) Notice: Subject to any disclaimer, the term of this patent is extended or adjusted under 35 U.S.C. 154(b) by 295 days.

(21) Appl. No.: 10/290,129

(22) Filed: Nov. 7, 2002

(65) Prior Publication Data

US 2004/0080503 A1 Apr. 29, 2004

(30) Foreign Application Priority Data

Oct. 24, 2002 (EP) ..... 02368116

(51) Int. Cl.
*G09G 17/00* (2006.01)

(52) U.S. Cl. ..... 345/211; 345/210; 345/50; 345/52; 345/92; 345/204; 345/205

(58) Field of Classification Search ..... 345/204–205, 345/50, 52, 92, 95–96, 98, 209–211
See application file for complete search history.

(56) References Cited

U.S. PATENT DOCUMENTS 6,137,465 A 10/2000 Sekine et al. ..... 345/98
6,172,661 B1 1/2001 Imajo et al. ..... 345/89
6,275,209 B1 * 8/2001 Yamamoto ..... 345/95
2002/0075217 A1 6/2002 Hashino
2003/0034946 A1 * 2/2003 Liang et al. ..... 345/89
2003/0156301 A1 * 8/2003 Kempf et al. ..... 358/486

FOREIGN PATENT DOCUMENTS

EP 0945844 A2 9/1999
WO WO 01/82284 A1 * 11/2001
WO WO 0182284 A1 11/2001

* cited by examiner

*Primary Examiner*—Richard Hjerpe
*Assistant Examiner*—Leonid Shapiro
(74) *Attorney, Agent, or Firm*—Saile Ackerman LLC; Stephen B. Ackerman

(57) ABSTRACT

This invention provides a method and an apparatus for saving power dissipation during the testing and evaluation of liquid crystal display LCD panels. In addition, this invention provides a method and apparatus of the changing of the order of backplane and segment addressing to reduce the power consumed by LCD panels. The method includes the step of interlacing the access of common or backplane addresses to an LCD. The LCD power saving method also includes the interlacing the access of the RAM data driving the LCD segment drivers. The segment address signals are developed from data read out of a random access memory, RAM. The segment address signals are activated such that alternating LCD panel locations are written with ones and zeros in a checkerboard pattern so as to stress the LCD panel in the worst case. This method provides for the saving of power dissipation during testing and evaluation by reducing the amount of segment switching from once every backplane cycle to once every frame.

24 Claims, 8 Drawing Sheets

FIG. 1 – Prior Art

FIG. 2 – Prior Art

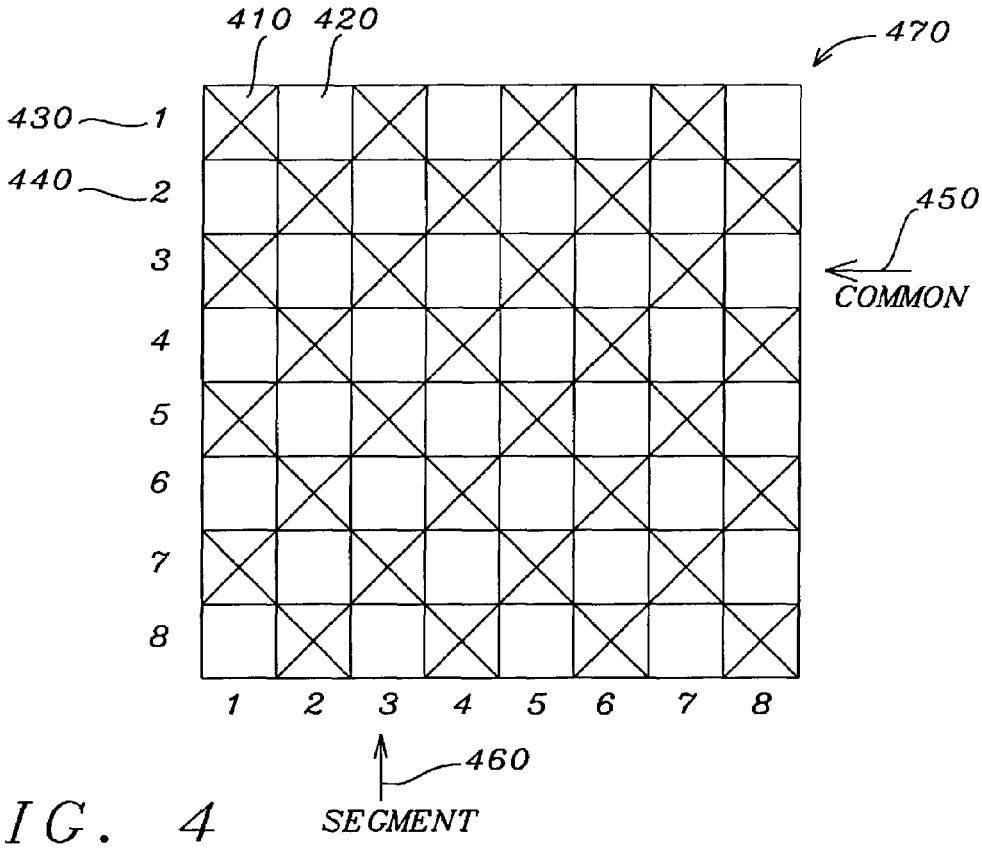
FIG. 4
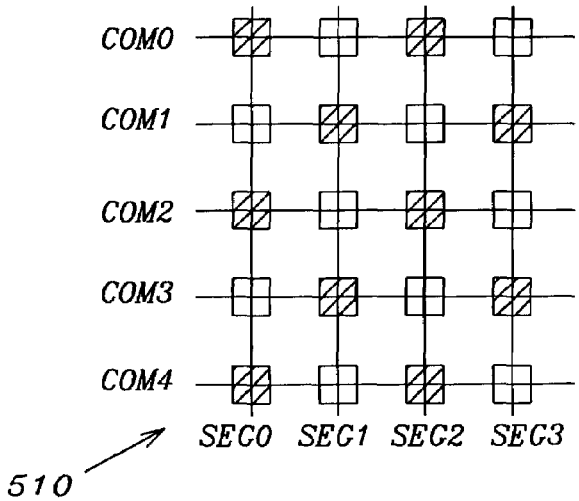
FIG. 5A – Prior Art

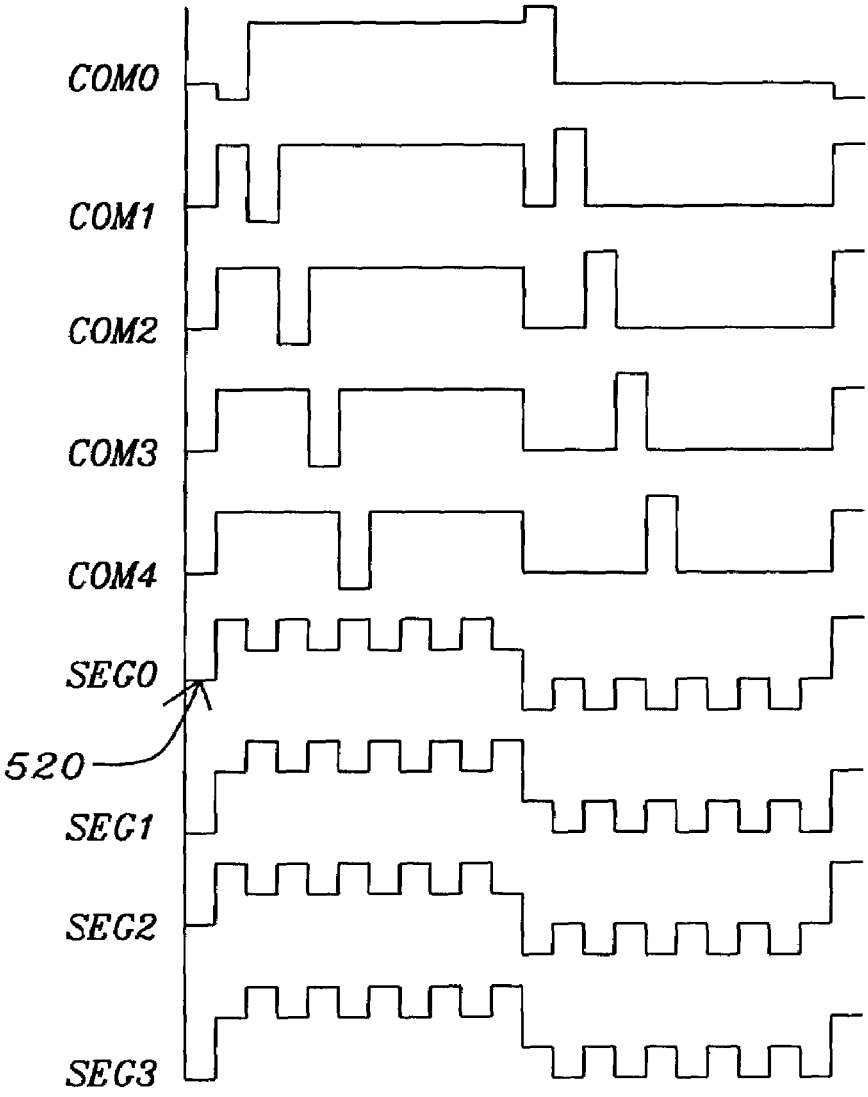
FIG. 5B – Prior Art

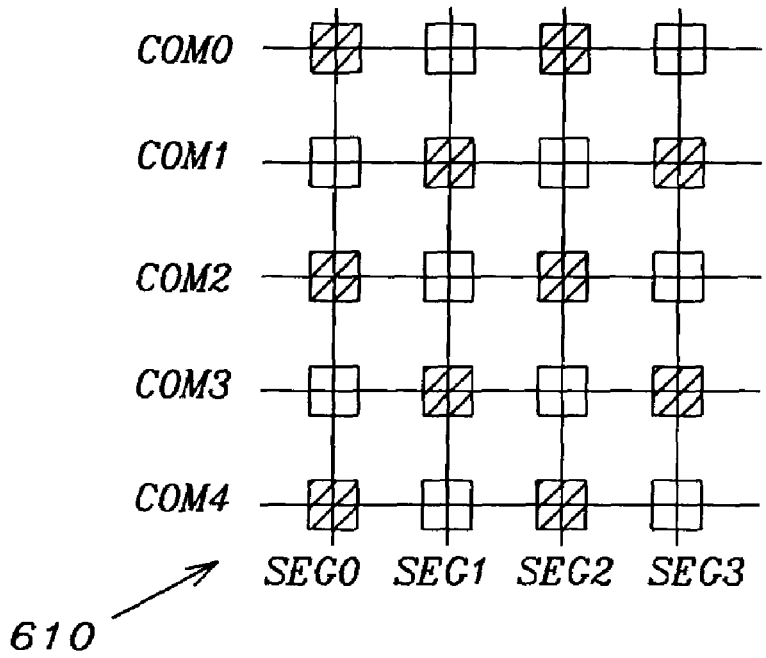
FIG. 6A – Prior Art

LCD DRIVER POWER SAVING DURING EVALUATION

BACKGROUND OF THE INVENTION

1. Field of the Invention

This invention relates to a method and an apparatus for saving power dissipation during the testing and evaluation of liquid crystal display LCD panels.

More particularly this invention relates to the changing of the order of backplane and segment addressing to reduce the power consumed by LCD panels.

2. Description of Related Art

Currently, liquid crystal display LCD panels are evaluated by using a checkerboard pattern displayed on the LCD panel as a worst case. This checkerboard panel display represents the worst case example for LCD panel power dissipation. The checkerboard pattern of LCD panel data 470 is shown in FIG. 4. The ones value is denoted by an 'X' in the LCD cell location 410. A zero value is illustrated with a blank square cell area 420 in FIG. 4. The LCD panel shown in FIG. 4 is an 8 by 8 matrix. There are 8 common or backplane addresses shown such as 430 which is an odd common address. An even common or 'com' address is also highlighted 440. FIG. 4 shows the com address 450. The com address line selects which row of the matrix in FIG. 4 is selected for writing to or reading from. FIG. 4 also shows the segment address 460. The segment address would select which column of the LCD panel is being written to or read from. A uniquely selected LCD panel cell is selecting by activating the combination of the appropriate segment address and com address in FIG. 4. For example, cell 420 in FIG. 4 is selected for writing to or reading from by activating com line 1 and segment line 2.

FIG. 1 shows a conventional prior art block diagram of an LCD panel display subsystem. The LCD panel 160 has segment addresses, Seg0, Seg1, Seg2, . . . Seg_n 110. These addresses are from the data output of a random access memory 140. An address control block 150 produces the read address 120 to the RAM as well as the Common or backplane connections Com0, Com1, Com2, . . . Com_n 130. As we showed in the previous discussion on FIG. 4, the segment address selects the column of the LCD panel matrix while the Com lines select the row of the LCD panel matrix.

FIG. 2 illustrates the timing diagram for the conventional RAM. The common backplane signals Com0, Com1, Com2, and Com3 210, 220.230. 240 occur sequentially every period. The timing diagram of the segment population is shown in FIG. 2. The column of the matrix is selected when the segment lines are low as we see 250, 290 in FIG. 2. During Com0 time 210, the even columns of the LCD matrix are selected via Seg0 and Seg2—250, 290. During Com1 time 220, the odd columns of the LCD matrix are selected via Seg1 and Seg3—270, 285. During Com2 time, the even columns of the LCD matrix are selected via Seg0 and Seg2—260, 275. During Com3 time 240, the odd columns of the LCD matrix are selected via Seg1 and Seg3—280, 295.

U.S. Pat. No. 6,172,661 (Imajo, et al.) "Low power driving method for reducing non-display area of TFT-LCD" describes a low power driving method for reducing non-display area of a thin film transistor liquid crystal display.

U.S. Pat. No. 6,275,209 (Yamamoto) "LCD driver" describes a liquid crystal display driver.

U.S. Pat. No. 6,137,465 (Sekine, et al.) "Drive circuit for a LCD device" discloses a drive circuit for a liquid crystal display device.

BRIEF SUMMARY OF THE INVENTION

It is the objective of this invention to provide a method and an apparatus for saving power dissipation during the testing and evaluation of liquid crystal display. LCD panels.

It is further an object of this invention to the changing of the order of backplane and segment addressing to reduce the power consumed by LCD panels.

The objects of this invention are achieved by a method that saves power consumption during the testing and evaluation of LCDs. The method includes the step of interlacing the access of common or backplane addresses to an LCD. The LCD power saving method also includes the interlacing the access of the RAM data driving the LCD segment drivers. The LCD power saving method continues with the presenting a common or backplane address to the LCD panel which selects the even common or backplane LCD drivers as a group in time sequence. The common or backplane signals are developed from an address control logic block. The common or backplane LCD addresses are activated in a time order of com0 first, com1 second, com2 third and com3 fourth. The com0, com1, com2 and com3 signals are each active for a period of time, which is the inverse of the frequency required to refresh, said LCD panel. The method also includes the presenting of a common or backplane address to the LCD panel which selects the odd common or backplane LCD drivers as a group in time sequence. The segment address signals are developed from data read out of a random access memory, RAM. The segment address signals are activated such that alternating LCD panel locations are written with ones and zeros in a checkerboard pattern so as to stress the LCD panel in the worst case. This method provides for the saving of power dissipation during testing and evaluation by reducing the amount of segment switching from once every backplane cycle to once every frame.

The LCD power saving method also saves power consumption during normal operation as well as during testing and evaluation by either interlacing the access of the common or backplane addresses or non-interlacing the access of the common or backplane addresses. This method of saving power during normal mode requires the selecting of either interlace or non-interlace modes depending on the content of the LCD display data. This normal mode LCD power saving method includes user selection of either interlace or non-interlace modes. This user selection is controlled by a programmable circuit, which senses the content of said display data.

BRIEF DESCRIPTION OF THE DRAWINGS

FIG. 4 illustrates the checkerboard data pattern that is used to test LCD panels.

FIG. 5*a* illustrates the prior art checkerboard data pattern.

FIG. 5*b* illustrates the prior art non-interlace control signals for LCD panels.

FIG. 6*a* illustrates a prior art checkerboard data pattern for testing the LCD.

DETAILED DESCRIPTION OF THE INVENTION

Figure 1:
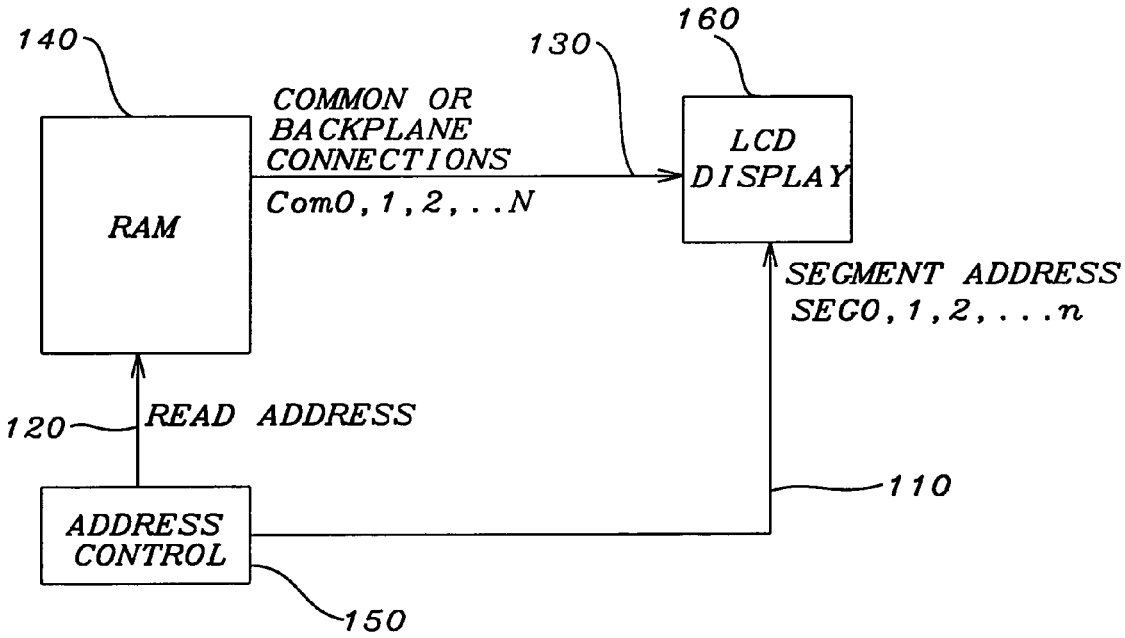
FIG. 1 shows a block diagram of an LCD panel system which helps to explain both the prior art and this invention.
Figure 2:
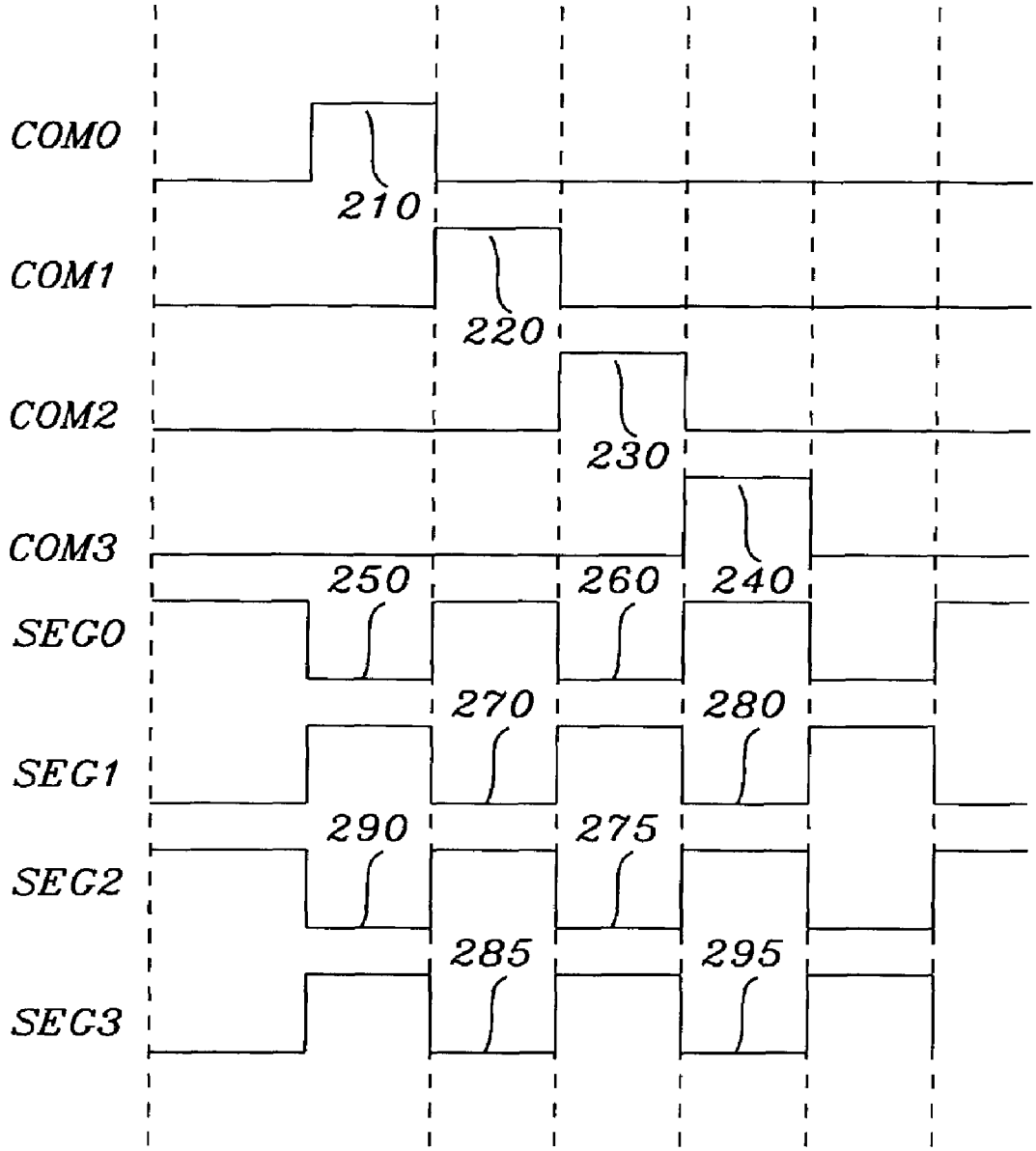
FIG. 2 gives a timing diagram of a prior art LCD panel system.

As described previously in the prior art section, FIG. 1 shows the block diagram for the reading and writing of LCD panels. The segment address, Seg0-n (110) selects which columns of the LCD panel 160 are being accessed for reading or writing. The common or backplane address connections, Com0-3 (130) determine which row of the LCD panel is accessed. These addresses are from the data output of a random access memory 140. An address control block 150 produces the read address 120 to the RAM as well as the Common or backplane connections Com0, Com1, Com2, . . . Com_n (130).

FIG. 4 illustrates an 8 by 8 LCD panel matrix. The LCD panel 470 in FIG. 4 is loaded with a checkerboard pattern of alternating ones and zeros, which 'X' denotes a one is stored. There are 8 common or backplane addresses shown such as 430 which is an odd common address. An even common or 'com' address is also highlighted 440. FIG. 4 shows the com address 450. The com address line selects which row of the matrix in FIG. 4 is selected for writing to or reading from. FIG. 4 also shows the segment address 460. The segment address would select which column of the LCD panel is being written to or read from. A uniquely selected LCD panel cell is selecting by activating the combination of the appropriate segment address and com address in FIG. 4. For example, cell 420 in FIG. 4 is selected for writing to or reading from by activating com line 1 and segment line 2.

Figure 3:
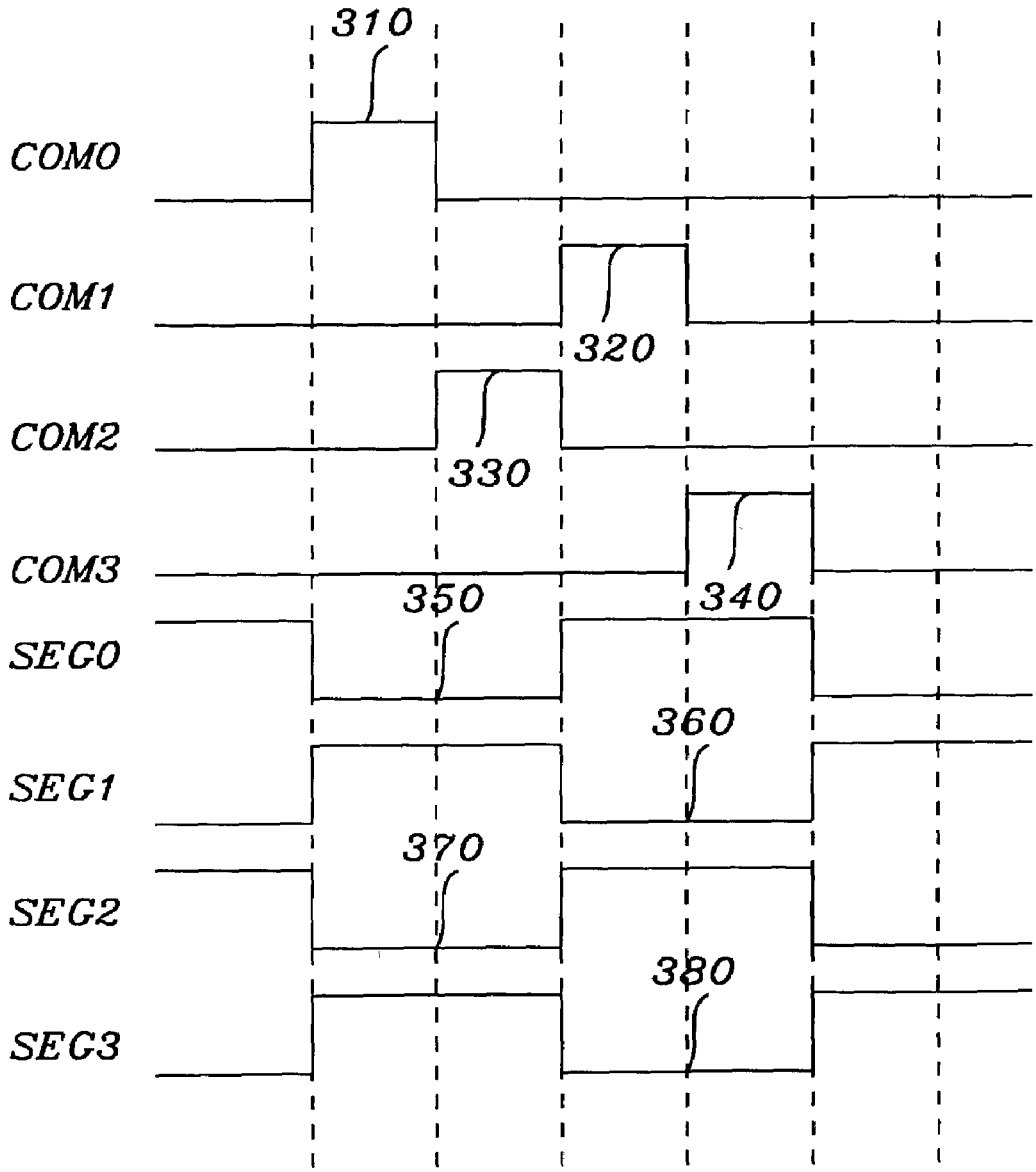
FIG. 3 gives a timing diagram of the LCD panel system of this invention.

FIG. 3 illustrates the timing diagram for the main embodiment of this invention. The common backplane signals Com0, Com1, Com2, and Com3 310, 320,330, 340 occur as shown in FIG. 3. The timing diagram of the segment signals is shown in FIG. 3. The column of the matrix is selected when the segment lines are low as we see 350, 370 in FIG. 3. During Com0 310 and Com1 time 330, the even columns of the LCD matrix are selected via Seg0 and Seg2—350, 370. During Com1 time 320 and Com3 time 340, the odd columns of the LCD matrix are selected via Seg1 and Seg3—360, 380.

FIG. 5 shows the prior art case of traditional non—interlaced LCD panel accessing. FIG. 5 gives the checkerboard data pattern loaded into the LCD panel 510.

Figure 6B:
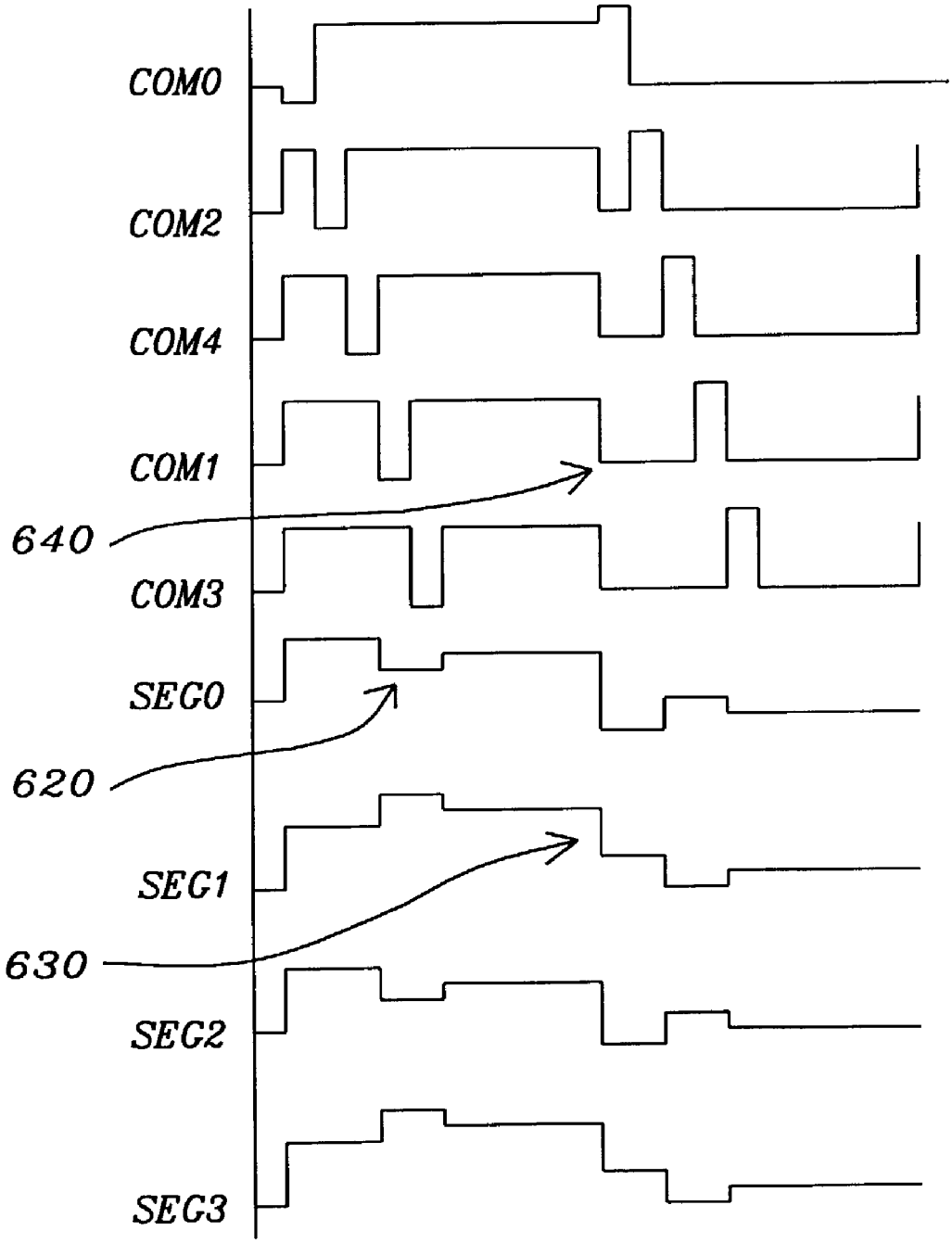
FIG. 6*b* illustrates the interlace timing diagram for the main embodiment of this invention.

FIG. 6*b* shows the timing diagram of the main embodiment of this invention of the new case of interlaced LCD panel accessing. FIG. 6*a* gives the checkerboard data pattern loaded into the LCD panel 610.

Figure 7:
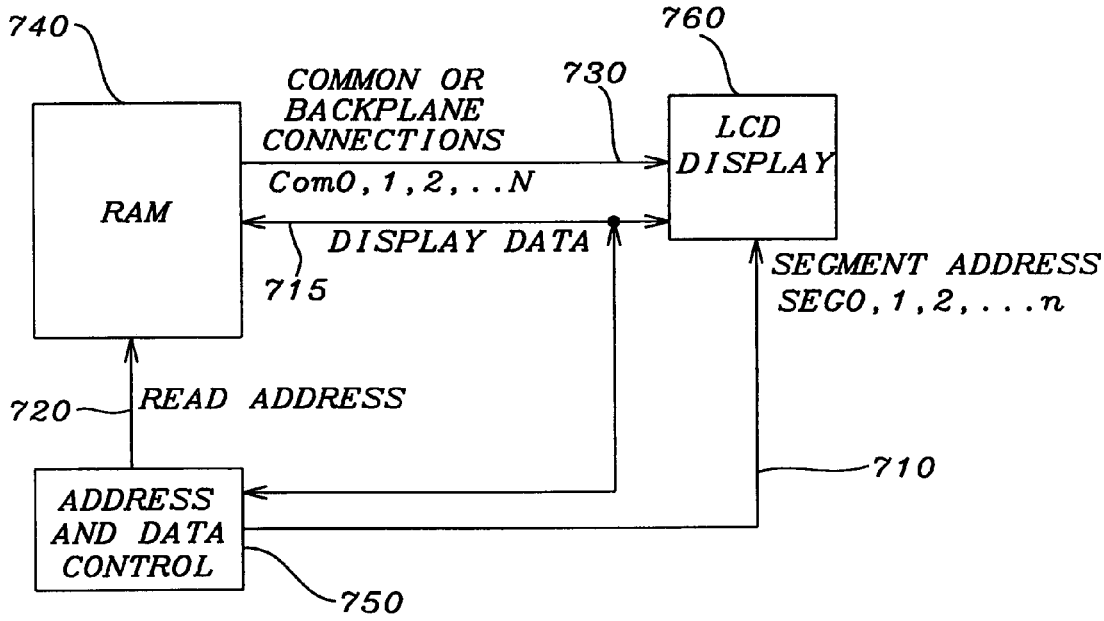
FIG. 7 shows a block diagram of the main embodiment of this invention.

FIG. 7 shows a block diagram of the main embodiment of this invention. An LCD panel display subsystem is shown. The LCD panel 760 has segment addresses, Seg0, Seg1, Seg2, . . . ,Seg_n (710). These addresses are from the data output of a random access memory, RAM, 740. The address control block 750 produces the read address 720 to the RAM, as well as the Common or backplane connections, Com0, Com1, Com2, . . . , Com_n (730). The segment address selects the column while the com lines select the row of the LCD panel matrix 760.

The present invention reduces the switching of the segment lines 710 from once every backplane cycle to once every frame. This saves substantial power in both the interlace and the non-interlace modes. If there are 100 backplane cycles per frame, power is saved by a factor of 100.

The main embodiment shown in FIG. 7 shows the display data 715 coming out of the RAM and being fed into the address and data control block 750, where the display data is decoded to determine if interlace or non-interlace mode should be activated. This mode change can happen automatically based on the content of the display data. The choice of interlaced or non-interlaced mode is activated via the Read addresses 720 and via the common or backplane addresses 730 coming out of the address and data control block 750. In addition, the address and data control block 750 provides for user programmability, allowing the user to force or select interlace or non-interlace modes. For example, the user may want to sacrifice image clarity for reduced power dissipation with interleave mode. Or, the user may want better LCD images at the expense of increased power dissipation.

The advantage of this LCD panel testing invention is the reduction of the total current, Idd drawn, in checkerboard testing mode. This is accomplished by reducing the amount of segment switching from once every backplane cycle to once every once every frame. As seen in FIG. 5, with the prior art non-interlace method the segment switches every backplane cycle 520. As seen in FIG. 6*b*, with the new interlace method the segment switches every frame 620. In addition, FIG. 6*b* shows the essence of the interlaced mechanism of this invention. On the plot of Seg1 in FIG. 6*b*, the transition from even to odd scan 630 shows that the operation of the segment lines is inverted during the odd frame, which follows the even frame. The segment line is inverted during the odd frame 630, which follows the even frame. Similarly, the Com signals are inverted during the odd frame which follows the even frame. Another advantage is that the principles of this invention in the testing and evaluating of LCD panels can be used during normal LCD panel operation in the field. This normal mode operation depends on the LCD data patterns.

While this invention has been particularly shown and described with Reference to the preferred embodiments thereof, it will be understood by those Skilled in the art that various changes in form and details may be made without Departing from the spirit and scope of this invention.

What is claimed is:

1. An LCD, liquid crystal display, driver power saving method comprising the steps of:

interlacing the access of common or backplane addresses to a LCD, or non-interlacing the access of common or backplane addresses to a LCD, wherein selecting said interlacing or said non-interlacing to provide optimum power saving depends on the content of display data, wherein power consumption is saved during the testing and evaluation of said LCD, by going into a data-dependent mode of operation which utilizes selection logic for forcing pre-selected display data, which is known to provide optimum low power testing environment.

2. The LCD power saving method of claim 1 further comprising the step of:

interlacing the access of RAM data driving the LCD segment drivers.

3. The LCD power saving method of claim 1 further comprising the step of:

presenting a common or backplane address to the LCD panel which selects the even common or backplane LCD drivers as a group in time sequence.

4. The LCD power saving method of claim 3 wherein common or backplane signals are developed from an address control logic block.

5. The LCD power saving method of claim 3 wherein said common or backplane LCD address is activated in a time order of a first address bit, a second address bit, a third address bit and a fourth address bit.

6. The LCD power saving method of claim 5 wherein said com0, com1, com2 and com3 signals are each active for a period of time which is the inverse of the frequency required to refresh said LCD panel.

7. The LCD power saving method of claim 1 further comprising the step of:

presenting a common or backplane address to the LCD panel which selects the odd common or backplane LCD drivers as a group in time sequence.

8. The LCD power saving method of claim 7 wherein segment address signals are developed from data read out of a random access memory, RAM.

9. The LCD power saving method of claim 7 wherein said segment address signals are activated such that alternating LCD panel locations are written with ones and zeros in a checkerboard pattern so as to stress the LCD panel in the worst case.

10. The LCD power saving method of claim 1 wherein power dissipation is saved during testing and evaluation by reducing the amount of segment switching from once every backplane cycle to once every frame.

11. An LCD power saving method which saves power consumption during normal operation of the LCD panel comprising the steps of:

providing an interlacing mode to the access of the common or backplane addresses, and providing a non-interlacing mode to the access of the common or backplane addresses, and selecting of said interlace or non-interlace modes depending on content of display data by going into a data-dependent mode of operation which utilizes selection logic for forcing pre-selected display data, which is know to provide optimum low power testing environment.

12. The LCD power saving method of claim 11 wherein said selecting of said interlace or non-interlace modes is controlled by a programmable circuit which senses the content of said display data.

13. An LCD, liquid crystal display, driver power saving apparatus comprising the means for:

interlacing the access of common or backplane addresses to a LCD, or non-interlacing the access of common or backplane addresses to a LCD, wherein selecting said interlacing or said non-interlacing to provide optimum power saving depends on the content of display data, wherein power consumption is saved during the testing and evaluation of said LCD, by going into a data-dependent mode of operation which utilizes selection logic for forcing pre-selected display data, which is known to provide optimum low power testing environment.

14. The LCD power saving apparatus of claim 13 further comprising the means for:

interlacing the access of the RAM data driving the LCD segment drivers.

15. The LCD power saving apparatus of claim 13 further comprising the means for:

presenting a common or backplane address to the LCD panel which selects the even common or backplane LCD drivers as a group in time sequence.

16. The LCD power saving apparatus of claim 15 wherein common or backplane signals are developed from an address control logic block.

17. The LCD power saving apparatus of claim 15 wherein said common or backplane LCD addresses are activated in a time order of com0 first, com1 second, com2 third and com3 fourth.

18. The LCD power saving apparatus of claim 17 wherein said com0, com1, com2 and com3 signals are each active for a period of time which is the inverse of the frequency required to refresh said LCD panel.

19. The LCD power saving apparatus of claim 13 further comprising the means for:

presenting a common or backplane address to the LCD panel which selects the odd common or backplane LCD drivers as a group in time sequence.

20. The LCD power saving apparatus of claim 19 wherein the segment address signals are developed from data read out of a random access memory, RAM.

21. The LCD power saving apparatus of claim 19 wherein said segment address signals are activated such that alternating LCD panel locations are written with ones and zeros in a checkerboard pattern so as to stress the LCD panel in the worst case.

22. The LCD power saving apparatus of claim 13 wherein power dissipation is saved during testing and evaluation by reducing the amount of segment switching from once every backplane cycle to once every frame.

23. An LCD power saving apparatus which saves power consumption during normal operation of the LCD panel comprising:

a means for an interlacing mode to access of the common or backplane addresses, and a means for a non-interlacing mode to access of the common or backplane addresses, and a means for selecting of said interlace or non-interlace modes depending on content of display data by going into a data-dependent mode of operation which utilizes selection logic for forcing pre-selected display data, which is known to provide optimum low power testing environment.

24. The LCD power saving apparatus of claim 23 wherein said user selection of said interlace or non-interlace modes is controlled by a programmable circuit which senses the content of said display data.

* * * * *